United States Patent [19]

Stutznäcker

[11] Patent Number: 4,597,344

[45] Date of Patent: Jul. 1, 1986

[54] METHOD OF OPERATING A SEWING MACHINE, ESPECIALLY A MULTI-NEEDLE SEWING MACHINE, AND AN ARRANGEMENT FOR PERFORMING THE METHOD

[75] Inventor: Klaus Stutznäcker, Frechen-Königsdorf, Fed. Rep. of Germany

[73] Assignee: Naehmaschinenfabrik Emil Stutznaecker GmbH & Co, KG, Cologne, Fed. Rep. of Germany

[21] Appl. No.: 689,556

[22] Filed: Jan. 7, 1985

[30] Foreign Application Priority Data

Jan. 5, 1984 [DE] Fed. Rep. of Germany ..... 3400206

[51] Int. Cl.[4] ..... D05B 97/00; D05B 55/06

[52] U.S. Cl. ..... 112/262.3; 112/79 R; 112/221; 112/227

[58] Field of Search ..... 112/262.3, 262.1, 221, 112/79 R, 308, 309, 227

[56] References Cited

U.S. PATENT DOCUMENTS 898,403 9/1908 Corey ..... 112/227

1,387,619 8/1921 Rosenthal ..... 112/221 X 1,444,632 2/1923 Moffatt et al. ..... 112/227

*Primary Examiner*—H. Hampton Hunter

*Attorney, Agent, or Firm*—Michael J. Striker

[57] ABSTRACT

A sewing machine, particularly a multi-needle sewing machine, includes at least one sewing arrangement which includes a reciprocating needle mounted on a needle holding arrangement and a gripper mounted on a gripper holding arrangement for angular displacement along a displacement plane and operative for engaging a thread delivered by the needle through the material being sewn to a predetermined region beyond the material. As the material is advanced, especially transversely of the displacement plane, during the sewing stroke of the needle, it acts on the needle and deviates the same from its initial course. To avoid malfunctions, at least one of the holding arrangements is mounted on the support for movement at least transversely of the displacement plane and parallel to the sewing plane of the material, and such one holding means is displaced by an appropriate moving arrangement in dependence on the extent of the deviation of the needle in such a manner that the distance between the needle and the displacement plane of the gripper is maintained substantially constant during the sewing stroke of the needle.

14 Claims, 9 Drawing Figures

METHOD OF OPERATING A SEWING MACHINE, ESPECIALLY A MULTI-NEEDLE SEWING MACHINE, AND AN ARRANGEMENT FOR PERFORMING THE METHOD

BACKGROUND OF THE INVENTION

The present invention relates to sewing machines in general, and more particularly to a method of and arrangement for operating a sewing machine, especially a multi-needle sewing machine, in which the material being sewn is advanced in any arbitrary direction along a sewing plane.

In sewing machines, it is encountered time and again that the needle is slightly deviated from its initial course or bent during its penetration into the material being sewn when the material is advanced in any direction along the sewing plane during the time that the needle passes into and/or beyond such material. This deviation or bending of the needle depends on the extent of advancement of the material while the needle is in engagement with such material, on the stability of the needle, and finally on the properties of the material being sewn, that is especially on how strong or how yieldable this material is.

In the classic sewing machine, which is equipped with a transporting arrangement for the material being sewn, the extent of deviation or bending of the needle is negligibly small, inasmuch as the transporting arrangement, generally speaking, advances the material being sewn only during such time periods during which the needle is situated outside the material being sewn.

Furthermore, there are known sewing machines in which the needle performs a defined movement together with the material being sewn. These machines are known as so-called needle-transport sewing machines. However, such machines permit the advancement of the material being sewn only in one direction, that is, in the direction which extends parallel to the plane in which the gripper is angularly displaced. There are also already known sewing machines in which not only the needle but also the gripper perform defined movements, which are derived from one or more cam discs. Such machines are commonly known as zig-zag or ornamental stitch sewing machines. Even in these sewing machines, however, the material being sewn is advanced only in the direction which extends parallel to the plane in which the gripper is angularly displaced or pivoted.

Newer developments in the field of automatization even in the area of sewing machines have led, especially in large sewing machine arrangements, such as multi-needle machines, to a situation where the material being sewn is advanced in any and all directions along a sewing plane in correspondence to the action of mechanical control cam curves and electronic control commands, in an automated manner. In this manner, there can be provided arbitrarily selected sewing patterns, such as inclined diamond or diamond pattern, or circular arc or circular pattern, or even contours of arbitrary shapes. In the machines of this kind, it is often no longer possible, especially in such sewing machines that operate at high speeds, so to control the advancement of the material being sewn that such advancement only takes place when the needle is not in contact with the material being sewn. The result of this is often a deflection of bending of the needle in the direction in which the material being sewn is being advanced.

This deflection or bending of the needle is relatively harmless, so long as the material being sewn is being advanced parallel to the displacement plane in which the gripper is being turned or pivoted. However, it becomes problematical when the material being sewn is being guided or advanced transversely to this gripper displacement plane, that is, either normal to the gripper displacement plane or at an angle smaller than 90° with respect to the latter, with a corresponding movement component normal to this displacement plane. As a result of this, there occurs also the deflection or bending of the needle transversely with respect to the gripper displacement plane. When this deflection or bending of the needle takes place away from the gripper, so that the distance between the needle and the gripper becomes larger than normal, there exists the danger that the tread loop may no longer be engaged or caught by the gripper tip. This results in faulty stitches and in thread breakages. When, on the other hand, the deflection of bending of the needle occurs in direction toward the gripper, it may happen that the gripper tips and the needle tip meet or collide. The result then may be breakage of the needle or damage to the gripper tip.

It is true that it was attempted to keep these disadvantageous consequences within limits by making the stitching hole which is provided in a support plate for the material being sewn and through which the needle passes on its way beyond the material and toward the gripper region, relatively narrow based on the desire better to guide the needle. However, from this results, in turn, another disadvantage, namely, that an increased wear of the needle is encountered owing to the lateral friction of the needle against the surface bounding this hole. Furthermore, an additional drawback is that the needle is sharpened during the up-and-down movement of the needle into, through, and out of the stitching hole, so that the needle becomes unusable for sewing after only a relatively short period of use thereof.

A further attempt at reducing the deflection or bending of the needle in accordance with conventional approaches resided in enlarging the cross section of the needle. However, this approach results, especially when the material being sewn is sensitive, in relatively large piercing holes with less than esthetically pleasing appearance, and very often in the damage to or breaking of the threads of the woven or knitted material being sewn.

SUMMARY OF THE INVENTION

Accordingly, it is a general object of the present invention to avoid the disadvantages of the prior art.

More particularly, it is an object of the present invention to provide a sewing machine, especially a multi-needle sewing machine, which does not possess the disadvantages of the conventional machines of this type.

Still another object of the present invention is to develop an operating method for a sewing machine which would be capable of avoiding sewing disruptions, such as thread breakages, faulty stitches or the like, which are caused by the advancement of the material being sewn and the deflection of the needle caused by the same, and of significantly improving the sewing conditions, especially the sewing reliance.

It is yet another object of the present invention so to construct the machine of the type here under consideration as to be capable of performing the above-mentioned method.

A concomitant object of the present invention is so to design the machine of the above type as to be relatively simple in construction, inexpensive to manufacture, easy to use, and reliable in operation nevertheless.

In pursuance of these objects and others which will become apparent hereafter, one feature of the present invention resides in a method of operating a sewing machine, especially a multi-needle sewing machine, in which the material to be sewn is advanced in any desired direction in a sewing plane delimited by a support, the respective needle is mounted on a needle holding arrangement and in operation moves with the thread substantially normal to the sewing plane through the material to a region situated beyond the latter, being deviated from its original course by the action of the material thereon as the latter advances during the sewing stroke, and a gripper associated with the needle is mounted on a gripper holding arrangement for angular displacement along a displacement plane substantially normal to the sewing plane into and out of the region to engage the thread thereat, at least one of the holding means being mounted on the support for movement relative thereto along a sewing plane, the inventive method comprising the steps of moving the one holding means along the sewing plane; and so controlling the movement of the holding means during the moving step and while the needle performs its sewing stroke in dependence on the needle deviation that the distance between the needle and the displacement plane of the gripper remains substantially constant in the course of the sewing stroke.

Thus, it may be seen that the present invention, in contradistinction to the conventional approaches which predominantly if not exclusively included attempts to take such measures as to reduce the extent of deviation or bending of the needle or keep the same within relatively small limits, is based on the recognition of the fact that the commercially available needles possess such a high elasticity that they can withstand the deflections or deviations and bendings of the needle, which are in any event relatively small, without any significant problems and over very long operation times, without encountering needle breakages or other similar disadvantageous occurrences. Hence, in accordance with the invention, precisely the elasticity of the sewing needle is being used in such a manner that small advancements of the material being sewn during the period of time during which the needle is in contact with the material being sewn do not result in any damage to the material being sewn, and this precisely because the needle is permitted to bend by this small amount corresponding to such small advancement or be elastically deflected or deviated from its initial course by this small amount, that is, because the needle participates to this extent in the advancement of the material being sewn.

Advantageously, the controlling step includes controlling the extent of movement of the holding arrangement in dependence on the speed of advancement of the material. When the present invention is used in a sewing machine in which control commands are issued for controlling the advancement direction and the advancement speed of the material, it is particularly advantageous when the controlling step includes controlling the extent of the movement of the one holding arrangement in dependence on such control commands. It is especially advantageous when the controlling step includes sensing the extent of the deviation of the needle, and controlling the movement of the one holding arrangement in dependence on the sensed values. However, it is also advantageous and contemplated by the present invention for the controlling step to include measuring the speed of advancement of the material in the angular range transversely of the displacement plane of the gripper, and controlling the movement of the one holding arrangement proportionally to the measured values.

In accordance with another aspect of the present invention, there is provided a moving arrangement for use in a sewing machine, especially a multi-needle sewing machine, in which the material to be sewn is advanced in any desired direction in a sewing plane delimited by a support, the respective needle is mounted on a needle holding arrangement and in use moves with the thread substantially normal to the sewing plane through the material to a region situated beyond the latter, being deviated from its initial course by the action of the material thereon as the latter advances during the sewing stroke, and a gripper associated with the needle is mounted on a gripper holding arrangement for angular displacement along a displacement plane substantially normal to the sewing plane into and out of the region to engage the thread thereat, at least one of the holding arrangements being mounted on the support for movement relative thereto at least parallel to the sewing plane, this moving arrangement comprising means for moving the one holding means along the sewing plane; and means for so controlling the operation of the moving means in dependence on the extent of the needle deviation as the needle performs its sewing stroke that the distance between the needle and the displacement plane of the gripper remains substantially constant in the course of the sewing stroke.

It is further advantageous in this context when the controlling means includes means for controlling the moving means in dependence on the advancement speed of the material. The arrangement of the present invention can be advantageously used in a sewing machine in which control commands are issued for controlling the advancement of the material, in which case the controlling means advantageously includes means for controlling said moving means in dependence on such control commands which control the advancement of the material transversely to the displacement plane.

According to another facet of the present invention, the controlling means includes sensing means for sensing the extent of deviation of the needle, including at least one sensor arranged at a distance from at least one needle and transversely to the displacement plane of the gripper. It is further advantageous when the controlling means includes a servosystem which is so constructed as to achieve displacement of the moving means which is proportional to the deviation of the needle.

The arrangement of the present invention is suited for use in a sewing machine which includes an electric motor that advances the material at least transversely of the displacement plane. In this case, the moving means advantageously includes an electromagnet connected to the one holding arrangement and equipped with a return spring, and the controlling means includes means for supplying an electric voltage which is in a predetermined ratio to the electric voltage energizing the electric motor to the electromagnet. In the alternative, the moving means includes a cylinder-and-piston unit interposed between the support and the one holding arrangement and connected thereto and including a cylinder bounding an internal space, a piston slidably received in the internal space and subdividing the same into two compartments, and a piston rod connected to the piston, and the controlling means includes a servo valve operative for controlling the distribution of fluid pressure to the compartments, a return spring acting on the servo valve, and means for supplying an electric voltage which is in a predetermined ratio to the electric voltage energizing the electric motor to the servo valve. However, the moving arrangement of the present invention may be advantageously so constructed that its moving means includes an electric servomotor acting on the one holding arrangement, and its controlling means includes a potentiometer directly coupled to the electric motor and operative for issuing an adjustable voltage, and means for applying a voltage difference between an electric voltage that is in a predetermined ratio to the electric voltage energizing the electric motor and the adjustable voltage to the electric servomotor.

In another modified construction of the moving arrangement according to the present invention which is used in a sewing machine equipped with a drive that advances the material, the moving means includes a cylinder-and-piston unit including a cylinder bounding an internal space, a piston receivied in the internal space for sliding therein and subdividing the internal space into two compartments, and a piston rod connected to the piston, one of the piston rod and cylinder being connected directly to one of the support and drive while the other of the piston rod and cylinder is connected to the other of the drive and support through a spring, this unit being so arranged that the advancements of the material transversely of the displacement plane are applied thereto. Then, the controlling means of such a moving arrangement includes conduit means communicating the compartments with one another and incorporating a throttling arrangement.

The novel features which are considered as characteristic of the invention are set forth in particular in the appended claims. The improved sewing machine, especially multi-needle sewing machine, itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
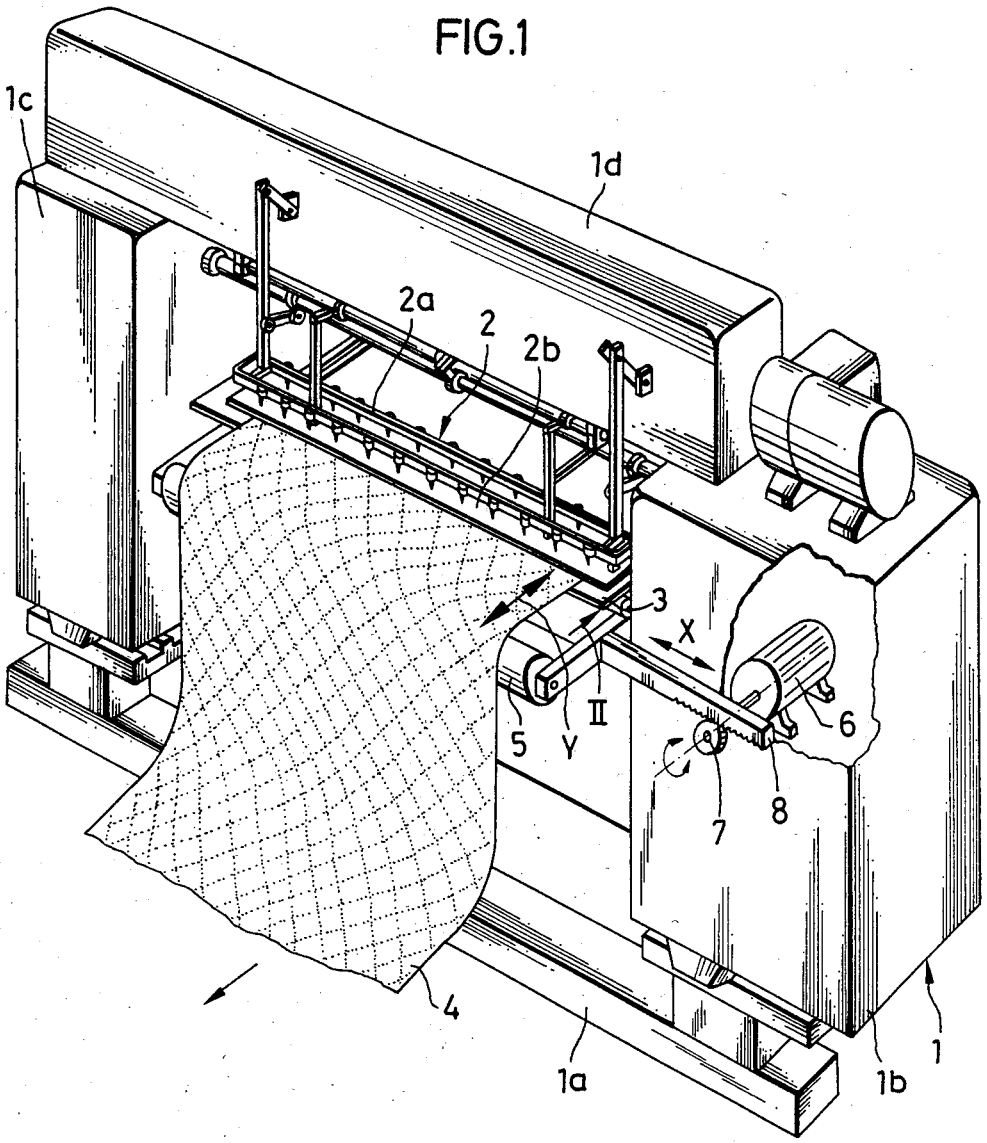
FIG. 1 is a perspective view of a multi-needle sewing machine equipped with a moving arrangement of the present invention.

Referring now to the drawing in detail, and first to FIG. 1 thereof, it may be seen that the reference numeral 1 has been used therein to identify a multi-needle sewing machine which is shown in a perspective view and, for the sake of clarity, in a considerably simplified manner. The sewing machine 1 illustrated in the drawing is constructed as a multi-needle double in-an-out stitch machine which includes a stationary base frame 1*a* and a generally U-shaped support frame displaceable with respect to the base frame 1*a* and including two lateral housing parts 1*b* and 1*c* and a transverse head 1*d* extending between and interconnecting the two lateral housing parts 1*b* and 1*c*. The to-and-fro shifting displacement in the directions indicated by a double-headed arrow x is achieved by means of an electric motor 6 which drives a gear 7 that meshes with a toothed rack 8. The toothed rack 8 is connected with a carriage which is of a known construction and includes a deflection roller 5. This controlled to-or-fro movement of the material to be sewn or stitched, which will hereafter be referred to as textile material for convenience even though it may be of a different character, texture, structure or material, in the transverse directions indicated by the arrow x serves, together with a controlled longitudinal displacement of the textile material in the longitudinal direction indicated by an arrow y, the purpose of providing any arbitrarily selected stitch or sewing pattern on the material 4 which may be constituted, for instance, by quilting lining or by a quilt-making material.

A stitching plate 3 is provided in the above-mentioned carriage. The stitching plate 3 is arranged in a stationary manner so that it does not participate in the to-and-fro movement of the carriage. Upwardly of the stitching plate 3, there is provided an upper thread guiding arrangement which is of a conventional construction. Furthermore, there are provided only diagrammatically indicated arrangements 2 for moving a common or shared needle holding arrangement 2*a* or a needle carrier, as well as a pressing foot arrangement 2*b*. Below the stitching plate, there are arranged known arrangement for the lower thread guidance as well as for the movement of grippers or gripper hooks which are connected in a single row or, as the case may be, in a plurality of rows on a gripper holding arrangement for each of the rows, such common gripper holding arrangement being usually constituted by a shaft.

Figures 2, 3, 4:
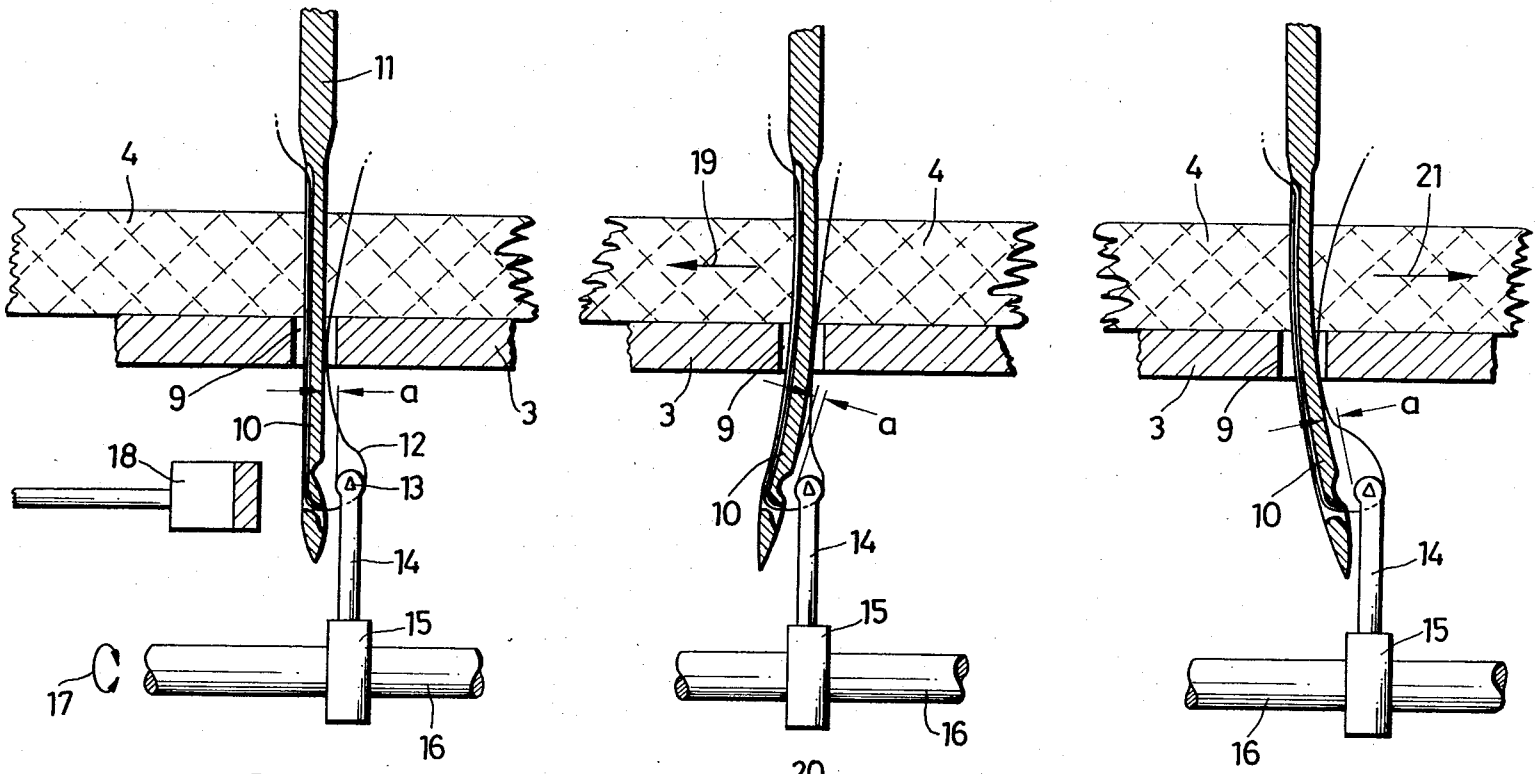
FIG. 2 is a partially cross-sectioned view, at an enlarged scale, of the area of the needle and gripper in an operating condition in which the needle is not bent and the gripper is not moved.
FIG. 3 is a view similar to FIG. 2 but in another operating condition in which the needle is bent to the left and the gripper is displaced, together with its holding arrangement, in the leftward direction.
FIG. 4 is another view similar to FIG. 2, but this time in a still another operating condition in which the needle is bent to the right and the gripper and its holding arrangement are displaced in the rightward direction.

FIG. 2 shows a vertical partial cross-sectional view taken through the stitching plate 3, on which the textile material 4 rests. The stitching plate 3 is provided with a stitching hole 9 for each needle 10. In practice, the stitching hole 9 may have a diameter which is even greater relative to the diameter of the needle 10 than what is shown in the drawing. The needle 10 has an upper shank 11 which is mounted on a needle holding arrangement that has not been depicted in FIG. 2. This needle holding arrangement is mounted, in common with the needle holding arrangements for all the needles 10 of the same row, on a common needle carrier or needle carrier beam which is being moved during the sewing operation in the upward and downward directions, so that the needle 10 penetrates, as shown, through the textile material 4 as well as through and beyond the stitching hole 9. Now, when the needle 10 is lifted from its lower reversing or dead-center position thereof by a small distance approximately into the illustrated position, there is formed a thread loop 12 in the upper thread which is entrained for joint movement with the needle 10.

A tip 13 of a gripper or gripper hook 14 penetrates into the thus formed thread loop 12. The gipper 14 is connected to a gripper holding arrangement 15. In a multi-needle machine, such as the multi-needle machine 1 of the present invention, the gripper 14 is mounted, together with all the other grippers 14 of the same row of grippers, on a shaft 16. The shaft 16 conducts, during the sewing operation, to-and-fro movements in the directions indicated by an arrow 17, so that the respective gripper 14 performs a pivoting movement or angular displacement in or along a plane that extends normal to the drawing plane of FIGS. 2 to 4. The distance between the needle 10, on the one hand, and the pivoting plane of the gripper 14 which is situated next to the respective needle 10 and is associated therewith, on the other hand, is indicated by a reference character a. This position of the needle 10 and the gripper 14 as illustrated in FIG. 2 with respect to one another results either when the textile material 4 stands still, or when it is displaced in a direction normal to the plane of the drawing. The position of the needle 10 can be exactly measured in each instance by a stationary sensor 18 which can be constructed as an induction sensor or as a Hall effect sensor, for instance.

When the textile material 4 is moved, in accordance with FIG. 3, in the direction of the arrow 19 or with a movement component in this direction, the needle 10 is bent to a certain extent in the leftward direction. This bending of the needle 10 is illustrated in FIG. 3 in a greatly exaggerated manner, for the sake of clarity. Furthermore, it is to be mentioned in this connection that in practice the needle 10 is not bent in its lower region downwardly of the guiding plate 3; rather, it is bent within the textile material 4 and at the region immidately upwardly of the textile material 4. However, what is important here is that, in each instance, the needle 10 is so bent that the distance thereof from the gripper 14 increases, so that it no longer certain and assured that the gripper tip 13 reaches into the loop 12. Therefore, according to the present invention, there is provided a drive which is connected to the gripper holding arrangement 15 and which is so constructed and so controlled that the gripper holding arrangement 15 is shifted or moved in dependence on the bending of the needle 10 caused by the textile material during its advancement of movement so that the distance a between the needle 10 and the plane of movement of the gripper 14 remains virtually the same. Hence, in this case, the movement of the gripper 14 by a certain distance takes place in the direction of the arrow 20. However, instead of, or even in addition to, the shifting or movement of the gripper holding arrangement 15 and thus of the gripper 14 and the gripper tip 13, there can be performed a corresponding shifting or displacement of the needle holding arrangement which is not shown in FIG. 3 so as not to unduly clutter the latter. In this instance, the displacement of the needle holding arrangement takes place in the rightward direction as considered in FIG. 3, in order to accomplish the substantially constant distance a despite the bending of the needle 10 in the leftward direction. When only the needle holding arrangement is displaced, the displacement thereof in the rightward direction is performed by the entire distance needed for keeping the plane of the gripper 14 and the bent needle 10 substantially equidistant. On the other hand, when both the needle holding arrangement and the gripper holding arrangement are displaced, as mentioned above, under certain circumstances, in opposite directions, then the total extent of such displacements substantially corresponds to the extent of the bending of the needle 10.

The displacement or shifting of the gripper holding arrangements or of the grippers 14 or of the gripper tips 13 on the one hand, and/or of the needle holding arrangements and needles 10, on the other hand, can be economically advantageously and simply achieved especially in multi-needle sewing machines, inasmuch as often a hundred or more grippers or gripper hooks 14 are arranged or mounted on a shaft, or a corresponding number of needles 10 is secured to or mounted on a beam of a similar needle holding arrangement. Even if there are provided several mutually parallel rows of needles or grippers in a multi-needle sewing machine, the needle holding arrangements of the individual rows and also the gripper holding arrangements of the corresponding rows are connected with one another, for instance, by corresponding holding frames, so that even under these circumstances in each instance only a single drive is required for displacing or shifting all of the gripper holding arrangements and grippers and/or all of the needle holding arrangements and needles.

The above explanations are also substantially valid for the situation illustrated in FIG. 4, in which the textile material 4 has been displaced or advanced in the direction of the arrow 21 or with a component of movement in this direction. In this case, the needle 10 is bent in the rightward direction so that, according to FIG. 4, the gripper holding arrangement 15 with the gripper 14 is displaced or shifted in the direction of the arrow 22, in order to once more obtain the above-mentioned substantially constant distance a between the needle 10 and the pivoting plane of the gripper 14 and to maintain the same regardless of the extent of bending of the needle 10.

The following discussion will address FIGS. 5 to 9 which illustrate various examples of arrangements for driving or shifting the gripper holding araangement and/or the needle holding arrangement, or more particularly the above-explained common gripper shafts 16 or common needle holding beams.

However, before the structural features of the exemplary embodiments of the driving arrangements are explored in detail, it is to be mentioned that, in principle, it is advantageous to control the drive for the shifting or displacement of the gripper holding arrangement and/or the needle holding arrangement in dependence on the advancement speed of the textile material. This proposal according to the present invention is based on the recognition of the fact that the needles are deviated from their original courses or are bent the more, the greater is the advancement speed of the textile material.

A further advantageous inventive feature used in the construction of the driving arrangement resides in the fact that the drive for the shifting or displacement of the gripper holding arrangement and/or of the needle holding arrangement is controlled in dependence on the control signals which control the direction and speed of advancement of the textile material. Inasmuch as these control arrangements, especially for pattern sewing machines, are usually constructed as electronic coordinate control arrangements, it is possible, as already mentioned before, to also use their control command signals for the direction and speed of displacement of the textile material in the direction transverse to the plane of movement of the gripper or the planes of movement of the grippers at the same time for the control of the displacement of the gripper holding arrangement or arrangements and/or of the needle holding arrangement or arrangements.

Advantageously, an electrical or electrohydraulic servo system is provided for the control of the driving arrangement, this system being so constructed that it produces displacement of the gripper holding arrangement and/or of the needle holding arrangement which is proportional to the measured values.

The measured values can also be obtained in such a manner that a sensor, for instance, an induction sensor or a Hall effect sensor, is arranged at a distance from but in the proximity of at least one of the needles and perpendicular to the plane of the pivoting or swinging motion of the respective associated gripper, this sensor being operative for measuring the extent of the needle deflection or bending. Generally, it is sufficient to measure the extent of deflection of only one of the needles during the corresponding instant of time during the sewing operation or at a particular location of the sewing displacement path, in that it can be properly assumed that at the same instant of time all needles are subjected to substantially the same forces and consequently undergo substantially the same deformation. In this connection, it is also to be mentioned that the control of the driving arrangement need not, in general, cause a change of the needle holding arrangement or of the gripper holding arrangement of the multi-needle sewing machine as far as its position is concerned during each and every sewing or stitching movement cycle. So, for instance, when the pattern being stitched or sewn is an inclined diamond pattern, the displaced position of the gripper holding arrangement and/or of the needle holding arrangement or arrangements remains unchanged for so long as it takes to sew or stitch a straight-line segment of the inclined diamond seam or stitch. A corresponding shifting or displacement of the gripper holding arrangement and/or the needle holding arrangement or arrangements takes place only at the corner points of the inclined diamond seam or stitch.

Figure 5:
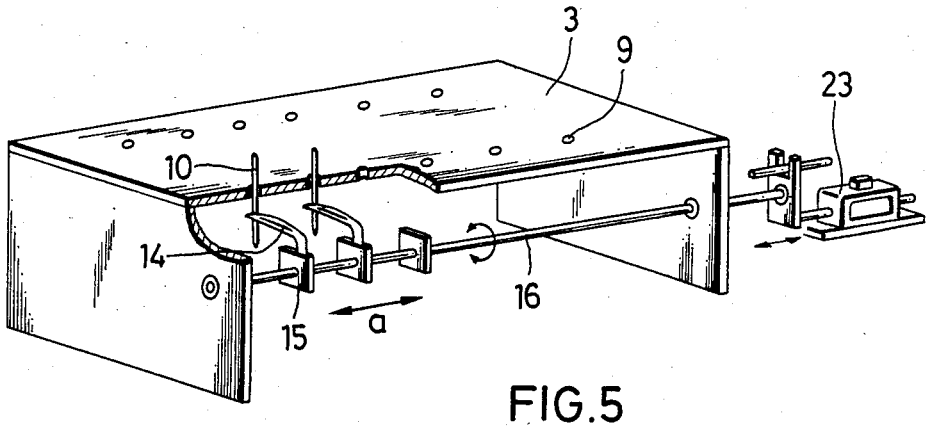
FIG. 5 is a simplified perspective view of one example of a moving arrangement for moving the gripper holding arrangement.
Figure 6:
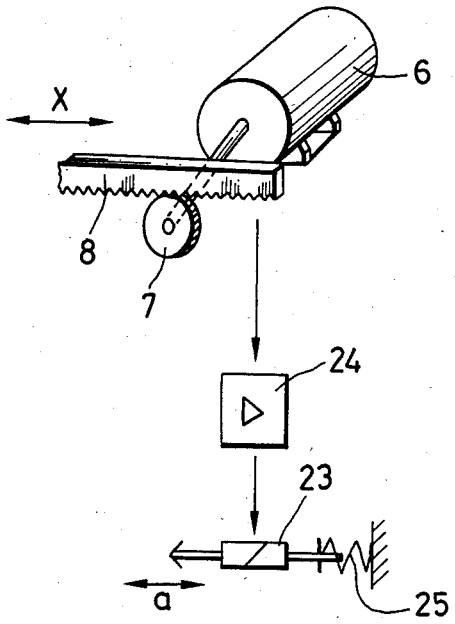
FIG. 6 is a view similar to FIG. 5 but showing a modification of the moving arrangement.

FIG. 5 shows, in a perspective view and in a simplified illustration one construction example of a driving arrangement for the shifting or displacement of a common shaft 16 for a multitude of grippers 14. In this instance, the driving arrangement substantially consists of a magnetically operated reciprocating drive 23. FIG. 6 then illustrates a corresponding functional diagram. It may be seen therein that the electrical voltage of the displacing motor 6, or a voltage of a tacho-generator derived therefrom, is supplied to the electromagnet or magnetically operating reciprocating drive 23, preferably via an amplifier 24, so that the movable core or armature of the magnetically operated reciprocating drive 23 applies a repositioning force in the direction of the arrow, in cooperation with a return spring 25, and thus causes the above-mentioned displacement or position change.

Figure 7:
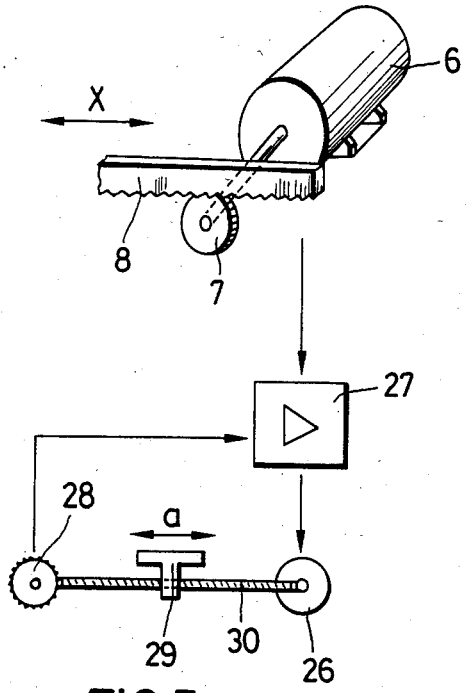
FIG. 7 is another view similar to FIG. 5 but of another modification of the moving arrangement.

FIG. 7 depicts a diagrammatic view of a further modified construction of a driving arrangement. In this case, there is provided as the driving arrangement an electric servomotor 26 or position-adjustment motor, the electric motor 26 being capable of being energized and driven via an amplifier 27 by the different voltage difference between two electric voltages, namely, on the one hand, of a first voltage of the above-discussed advancement or displacement motor 6 or a tacho-generator voltage derived therefrom and, on the other hand, a second voltage derived from and controllable by a potentiometer 28. The potentiometer 28 is directly connected with the electric servomotor 26 of position-adjustment motor. As explained above, the displacement or advancement motor 6 serves for the advancement or displacement of the textile material in the transverse direction or, in other words, in direction normal to the swinging or pivoting movement of the grippers 14. The electric servomotor 26 or position-adjustment motor is connected with the gripper holding arrangement or with the needle holding arrangement, as mentioned above. Advantageously, as shown in FIG. 7, this connection is accomplished with the interposition of a structural component 29 which is mounted on a spindle 30 that is driven by the servomotor 26, for instance. Hence, the operation is such that the voltage applied to the advancement or displacement motor 6, or a tacho-generator voltage derived therefrom, is compared with s second voltage derived from the potentiometer 28. The difference between these voltages is then used to energize or drive the servomotor 26 or position-adjustment motor via the amplifier 27 for so long until the difference between these voltages is reduced to zero. As mentioned above, the second voltage is controlled by the potentiometer 28 which is adjustable and which, in turn, is directly coupled with the servomotor or position-adjustment motor 26.

Figure 8:
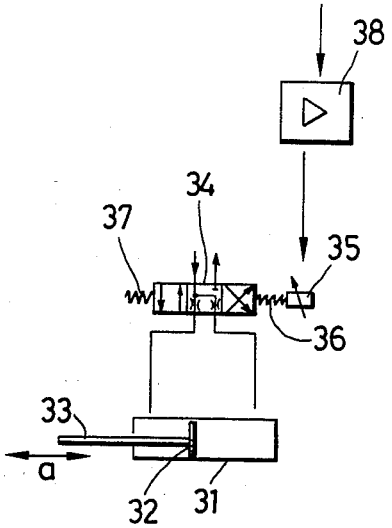
FIG. 8 is still another view similar to FIG. 5 showing a further modification of the moving arrangement.

FIG. 8 depicts a diagram of an additional modified construction of the driving arrangement. Herein, the driving arrangement is constructed as a double-acting pneumatic or hydraulic cylinder-and-piston arrangement which includes a cylinder 31 and a piston 32 slidably received in the latter. A piston rod 33 of the piston 32 is connected to the above-discussed gripper holding arrangement or needle holding arrangement. The compartments situated at the opposite axial sides of the piston 32 are supplied with pressurized fluid, or such fluid is discharged therefrom, all under the control of an electro-hydraulic or electro-pneumatic servo valve 34. The servo valve 34 is acted on in one axial direction by an electromagnetically operated arrangement 35 with the interposition of a spring 36, and in the opposite axial direction by a return spring 37. Similarly to what has been described above in connection with the previously explained examples of the construction of the driving arrangement as depicted in FIGS. 6 and 7, even here the speed and direction of the advancement of the textile material are directly meansured at the corresponding displacement or advancement motor 6, especially by the measurement of the corresponding electrical voltage or potential difference, or by measuring a pulse frequency when a pulse generator is being used or by measuring the voltage or potential difference at a tacho-generator. When the voltage existing at the advancement or displacement motor 6 or the aforementioned tacho-generator is being used, it is merely necessary to supply this voltage or portential difference, possibly through the amplifier and utilizing the amplification thereof, to the above-mentioned electromagnetically operated servo valve 34, and more particularly to the electromagnetic arrangement 35 of this servo valve 34, so that the servo valve 34 is opened to a greater or lesser degree in dependence on the applied voltage. The pneumatic or hydraulic cylinder-and-piston arrangement 31 to 33 which is arranged downstream of the servo valve 34 will thus be able to exert a greater or a lesser force correspondingly to the degree of opening of the servo valve 34, this force being then transmitted by the piston rod 33 of the piston 32 and, consequently, resulting in a defined shiftting or displacement.

Figure 9:
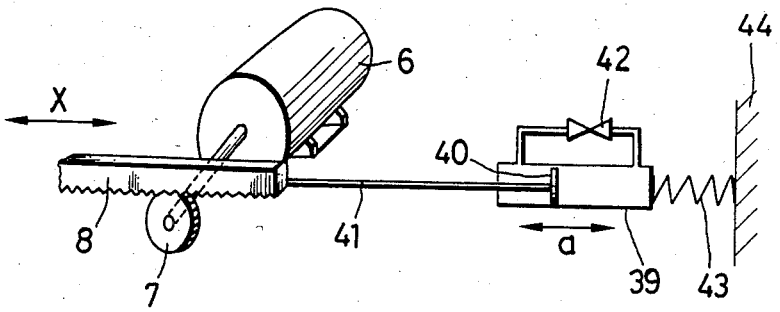
FIG. 9 is yet another view akin to FIG. 5 but depicting yet another modified version of the driving arrangement.

FIG. 9 illustrates another modified construction of an exemplary embodiment of the driving arrangement according to the present invention, wherein the driving arrangement in this construction includes a double-acting cylinder-and-piston arrangement including a cylinder 39 and a piston 40 slidably received in the interior of the cylinder 39, the arrangement 39 and 40 being of either the hydraulically operated or of the pneumatically operated type. The piston 40 has a piston rod 41 rigidly connected thereto, the piston rod 41 being so connected with the advancement or displacement arrangement for the textile material that the shifting movements of the textile material in the directions normal to the plane of pivoting of the respective gripper are transmitted or applied thereto. The cylinder spaces situated at the opposite axial sides of the piston 40 are connected with one another, with the interposition of a throttling arrangement 42. Furthermore, the cylinder 39 is connected, on the one hand, with a stationary part 44 of the machine frame through the intermediary of a spring 43 and, on the other hand, with the gripper holding arrangement or the needle holding arrangement, as the case may be, as indicated by a double-headed arrow. In this manner, there is obtained the possibility to realize the shifting displacement of the gripper holding arrangement and/or needle holding arrangement or arrangements purely mechanically. The advancement or movement of the textile material in the directions transverse to the plane of the swinging or pivoting movement of the gripper is thus coupled with the movement of the piston 40 which transports the air or other gaseous medium or the oil or other hydraulic medium contained within the cylinder 39 through the throttle 42 from one of its axial sides to the other. Consequently, the movement of the cylinder 39 is a function of the adjustment of the throttle 42, the spring force and characteristic of the spring 43, the character of the medium contained in the cylinder 39, the size of the piston 40 and so on, but also, above all, of the advancement movement speed and advancement movement direction of the textile material.

It was explained in connection with the above-discussed examples of structures embodying the present invention how it can be achieved to very exactly move, and control the movement of, the respective gripper holding arrangement or the needle holding arrangement correspondingly to the extent of the bending of the needle or needles. However, in the simplest case. it is also sufficient, under certain circumstances, to control the movement of the gripper and/or of the needle only in dependence on the direction of movement of the textile material, that is, with predetermined movement distances, and more particularly with predetermined unitary displacement distances to one or the other side in the transverse directions. These displacement distances can be obtained based on experiments or practical experience.

It will be understood that each of the elements described above, or two or more together, may also find a useful application in other types of arrangements differing from the type described above.

While the invention has been illustrated and described as embodied in a multi-needle sewing machine for textile materials, it is not intended to be limited to the details shown, since various modifications and structural changes may be made without departing in any way from the spirit of the present invention. So, for instance, the material being sewn need not necessarily be fabric or other woven, knit, or non-woven textile material; rather, it can be any other material, such as paper, fleece, fiberglass or even metal foil or leather, so long as such material can be penetrated by the needle or needles and is to be provided with a predetermined stitching or sewing pattern which has sections extending at an acute or obtuse angles with respect to the main advancement direction.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A method of operating a sewing machine, especially a multi-needle sewing machine, in which the material to be sewn is advanced in any desired direction in a sewing plane delimited by a support, the respective needle is mounted on a needle holding arrangement and in operation moves with the thread substantially normal to the sewing plane through the material to a region situated beyond the latter, being deviated from its initial course by the action of the material thereon as the latter advances during the sewing stroke, and a gripper associated with the needle is mounted on a gripper holding arrangement for angular displacement along a displacement plane substantially normal to the sewing plane into and out of the region to engage the thread thereat, at least one of the holding means being mounted on the support for movement relative thereto along the sewing plane, comprising the steps of moving the one holding means along the sewing plane, and so controlling the movement of the one holding means during the moving step and while the needle performs its sewing stroke in dependence on the needle deviation that the distance between the needle and the displacement plane of the gripper remains substantially constant in the course of the sewing stroke.

2. The method as defined in claim 1, wherein said controlling step includes controlling the extent of the movement of the one holding arrangement in dependence on the speed of advancement of the material.

3. The method as defined in claim 1 for use in a sewing machine wherein control commands are issued for controlling the advancement direction and the advancement speed of the material, wherein said controlling step includes controlling the extent of the movement of the one holding arrangement in dependence on the control commands.

4. The method as defined in claim 1, wherein said controlling step includes sensing the extent of the deviation of the needle, and controlling the movement of the one holding arrangement in dependence on the sensed values.

5. The method as defined in claim 1, wherein said controlling step includes measuring the speed of advancement of the material in an angular range transversely to the displacement plane of the gripper, and controlling the movement of the one holding arrangement proportionally to the measured values.

6. A moving arrangement for use in a sewing machine, especially a multi-needle sewing machine, in which the material to be sewn is advanced in any desired direction in a sewing plane delimited by a support, the respective needle is mounted on a needle holding arrangement and in use moves with the thread substantially normal to the sewing plane through the material to a region situated beyond the latter, being deviated from its initial course by the action of the material thereon as the latter advances during the sewing stroke, and a gripper associated with the needle is mounted on a gripper holding arrangement for angular displacement along a displacement plane substantially normal to the sewing plane into and out of the region to engage the thread thereat, at least one of the holding arrangements being mounted on the support for movement relative thereto at least parallel to the sewing plane, comprising means for moving the one holding means along the sewing plane; and means for so controlling the operation of said moving means in dependence on the extent of the needle deviation as the needle performs its sewing stroke that the distance between the needle and the displacement plane of the gripper remains substantially constant in the course of the sewing stroke.

7. The arrangement as defined in claim 6, wherein said controlling means includes means for controlling said moving means in dependence on the advancement speed of the material.

8. The arrangement as defined in claim 6 for use in a sewing machine wherein control commands are issued for controlling the advancement of the material, wherein said controlling means includes means for controlling said moving means in dependence on such control commands that control the advancement of the material transversely to said displacement plane.

9. The arrangement as defined in claim 6, wherein said controlling means includes means for sensing the extent of deviation of the needle, including at least one sensor arranged at a distance from at least one needle and transversely to the displacement plane of the gripper.

10. The arrangement as defined in claim 6, wherein said controlling means includes a servosystem which is so constructed as to achieve displacement of said moving means which is proportional to the deviation of the needle.

11. The arrangement as defined in claim 6 for use in a sewing machine which includes an electric motor that advances the material at least transversely of the displacement plane, wherein said moving means includes an electromagnet connected to said one holding arrangement and equipped with a return spring; and wherein said controlling means includes means for supplying an electric voltage which is in a predetermined ratio to the electric voltage energizing the electric motor to the electromagnet.

12. The arrangement as defined in claim 6 for use in a sewing machine which includes an electric motor that advances the material at least transversely of the displacement plane, wherein said moving means includes a cylinder-and-piston unit interposed between the support and the one holding arrangement and connected thereto and including a cylinder bounding an internal space, a piston slidingly received in said internal space and subdividing the same into two compartments, and a piston rod connected to said piston; and wherein said controlling means includes a servo valve operative for controlling the distribution of fluid pressure to said compartments, a return spring acting on said servo valve, and means for supplying an electric voltage which is in a predetermined ratio to the electric voltage energizing the electric motor to the servo valve.

13. The arrangement as defined in claim 6 for use in a sewing machine which includes an electric motor that advances the material at least transversely of the displacement plane, wherein said moving means includes an electric servomotor acting on the one holding arrangement; and wherein said controlling means includes a potentiometer directly coupled to the electric motor and operative for issuing an adjustable voltage, and means for applying a voltage difference between an electric voltage that is in a predetermined ratio to the electric voltage energizing the electric motor and said adjustable voltage to said electric servomotor.

14. The arrangement as defined in claim 6 for use in a sewing machine equipped with a drive that advances the material, wherein said moving means includes a cylinder-and-piston unit including a cylinder bounding an internal space, a piston received in said internal space for sliding therein and subdividing said internal space into two compartments, and a piston rod connected to said piston, one of said cylinder and piston rod being connected directly to one of the support and drive while the other of the piston rod and cylinder is connected to the other of the drive and support through a spring, said unit being so arranged that the advancements of the material transversely of the displacement plane are applied thereto; and wherein said controlling means includes conduit means communicating said compartments with one another and incorporating a throttling arrangement.

* * * * *